US007333741B2

(12) United States Patent
Tokushige

(10) Patent No.: US 7,333,741 B2
(45) Date of Patent: Feb. 19, 2008

(54) IMAGE FORMING DEVICE

(75) Inventor: Akane Tokushige, Osaka (JP)

(73) Assignee: Kyocera Mita Corporation, Osaka (JP)

( * ) Notice: Subject to any disclaimer, the term of this patent is extended or adjusted under 35 U.S.C. 154(b) by 37 days.

(21) Appl. No.: 11/258,224

(22) Filed: Oct. 26, 2005

(65) Prior Publication Data

US 2007/0092276 A1 Apr. 26, 2007

(51) Int. Cl.
*G03G 15/02* (2006.01)

(52) U.S. Cl. ..... 399/50

(58) Field of Classification Search ..... 399/50
See application file for complete search history.

(56) References Cited

U.S. PATENT DOCUMENTS 6,122,460 A * 9/2000 Meece et al. ..... 399/31
7,076,181 B2 * 7/2006 Kellie et al. ..... 399/50
2007/0014584 A1 * 1/2007 Fletcher et al. ..... 399/50
2007/0086801 A1 * 4/2007 Sakato et al. ..... 399/50

* cited by examiner

*Primary Examiner*—David M. Gray
*Assistant Examiner*—Ruth N LaBombard
(74) *Attorney, Agent, or Firm*—Global IP Counselors, LLP

(57) ABSTRACT

An image forming device comprises: charging means for uniformly charging the surface of a photosensitive member; charging control means for controlling the charging output of the charging means; and table storing means for storing a plurality of control tables stipulating controlled variables for controlling the charging output in relation to the passage of time, the charging control means controlling the charging output based on one or more control tables selected from the plurality of control tables stored in the table storing means.

9 Claims, 5 Drawing Sheets

IMAGE FORMING DEVICE

FIELD OF THE INVENTION

The present invention relates to an image forming device such as a copier, printer, or the like, and particularly to an image forming device which makes possible the adjustment of the charging potential of the surface of the photosensitive member, the developing bias potential of the developing means, and the like, so as to form suitable images.

BACKGROUND INFORMATION

In an image forming device using an electrophotographic process, foreign matter such as corona products, paper filler, and the like adhere to the surface of the photosensitive member through use over a long period of time; as a result of the drop in charging potential of the photosensitive member surface, developer adheres to non-image portions of the electrostatic latent image formed on the photosensitive member surface, resulting in the problem of the so-called fogging phenomenon, where developer is transferred to the non-image portions, which is to say blank portions, of the image transferred to the recording paper.

The following is known as a technology for suppressing this fogging phenomenon, for example: a technology comprising developing bias voltage control signal output means for outputting a developing bias voltage control signal, and a developing bias voltage varying circuit for varying the developing bias voltage of the developing means based on the developing bias voltage control signal output therefrom, the developing bias voltage of the developing means being raised or lowered according to key operations by a user. In another known technology, instead of key operations by a user, the developing bias voltage of the developing means is automatically raised or lowered based on a detected value of a density sensor for detecting the number of images recorded on recording paper, and the degree of fogging.

Another technology, for example, comprises density detecting means for detecting the density of a reference toner image formed on the photosensitive member; fog removal level input means (switch) for setting the fog removal level; first selecting means for selecting the optimal combination of the grid voltage for the charging means and the bias voltage of the developing means from predetermined combinations; and second selecting means for selecting one grid voltage from among a plurality of predetermined grid voltages with the grid voltage selected with the first selecting means as the standard corresponding to the fog removal level set with the fog removal level input means; wherein the grid voltage being changed according to the fog removal level set by the user. A technology is known where the fog removal level is set automatically according to the magnitude of the detected value from the density detecting means for detecting the density of the reference toner image formed on the photosensitive member, instead of the user setting the fog removal level using the fog removal level input means (switch).

However, in technologies such as described above, wherein the user inputs a change or a setting for the developing bias voltage or grid voltage with a key operation (switch operation) and the developing bias voltage or grid voltage is adjusted according to that input, the fogging phenomenon is temporarily resolved when the user who noticed the fogging phenomenon adjusts the developing bias voltage or grid voltage with a key operation (switch operation); however, when the operation of the image forming device continues, the fogging phenomenon occurs again and the user must again input the change or the setting of the developing bias voltage or grid voltage with a key operation (switch operation) when the fogging phenomenon occurs.

In technologies such as described above, wherein the developing bias voltage or grid voltage is adjusted automatically based on a detected value from a density detecting sensor or the like, it is necessary to provide a sensor for detecting the density of the standard toner image formed on the photosensitive member, a potential detecting sensor for detecting the surface potential of the photosensitive member, or the like; and the constitution of the device becomes complex, so that the cost becomes high.

The present invention was developed in view of these problems; an object thereof is to provide an image forming device which effectively suppresses the fogging phenomenon with a simple device constitution and which reduces the amount of work involved in the user inputting the adjustment to the charging output and the developing bias.

SUMMARY OF THE INVENTION

A first characteristic constitution of an image forming device according to the present invention for achieving this object comprises: charging means for uniformly charging the surface of a photosensitive member; charging control means for controlling the charging output of the charging means; and table storing means for storing a plurality of control tables stipulating a controlled variable for controlling the charging output in relation to the passage of time; the charging control means controlling the charging output based on one or more control tables selected from among the plurality of control tables stored in the table storing means.

With this first characteristic constitution, the fogging phenomenon can be effectively suppressed while the work for the user to adjust the charging output is reduced, by the selective use of a plurality of control tables stipulating the controlled variable for controlling the charging output in relation to the passage of time. Also, because it is not necessary to detect the density of the toner image formed on the photosensitive member, the surface potential of the photosensitive member, or the like, the device can have a simple constitution without the use of a density detecting sensor, potential detecting sensor, or the like.

A second characteristic constitution of an image forming device according to the present invention comprises: developing means for supplying developer to and developing the photosensitive member surface whereon an electrostatic latent image is formed after uniform charging followed by partial exposure; developing bias control means for controlling the developing bias of the developing means; and table storing means for storing a plurality of control tables stipulating the controlled variable for controlling the developing bias in relation to the passage of time; the developing bias control means controlling the developing bias on the basis of one or more control tables selected from among the plurality of control tables stored in the table storing means.

With this second characteristic constitution, the fogging phenomenon can be effectively suppressed while the work for the user to adjust the developing bias is reduced, by the selective use of a plurality of control tables stipulating the controlled variable for controlling the developing bias in relation to the passage of time. Also, because it is not necessary to detect the density of the toner image formed on the photosensitive member, the surface potential of the photosensitive member, or the like, the device can have a simple constitution without the use of a density detecting sensor, potential detecting sensor, or the like.

In a third characteristic constitution of an image forming device according to the present invention, the plurality of control tables stored in the table storing means include control tables for a plurality of levels stipulating the controlled variable incrementally in relation to a predetermined passage of time.

With this third characteristic constitution, because of the selective use of control tables for a plurality of levels stipulating the controlled variable for controlling the charging output or developing bias incrementally in relation to a predetermined passage of time, the charging output or developing bias can be adjusted with a simple operation simply by selecting the level of the control table, and the fogging phenomenon can be effectively suppressed while the work for the user is reduced.

A fourth characteristic constitution of an image forming device according to the present invention is an image forming device, wherein an electrostatic latent image is formed after uniform charging of the photosensitive member and then partial exposure, developer is supplied to the image portion of this electrostatic latent image and the image is developed, and then transferred to recording paper, the control tables for a plurality of incrementally stipulated levels being stipulated so that a control table at each level matches the properties of each recording paper which can be used in the device.

With this fourth characteristic constitution, the level of the control table matching the properties of the recording paper which is principally used is selected when the image forming device starts to be used, or during use thereof, whereby the fogging phenomenon can be effectively suppressed while the amount of work for selecting the level of the control table can be reduced thereafter.

A fifth characteristic constitution of an image forming device according to the present invention is an image forming device, wherein an electrostatic latent image is formed after uniform charging of the photosensitive member and then partial exposure, developer is supplied to the image portion of this electrostatic latent image and the image is developed, and then transferred to recording paper; wherein the difference between the controlled variables at adjacent levels of the control tables for a plurality of incrementally stipulated levels is established based on the amount of change to the controlled variable required to reduce visible adhesion of developer to non-image portions of the image transferred to the recording paper to a non-visible level.

With this fifth characteristic constitution, it becomes possible to reduce the visible fogging phenomenon to a non-visible level with a simple operation of selecting the level of the control table.

In the characteristic constitutions of the present invention, the plurality of control tables stored in the table storing means can include one or both of the control tables stipulating the controlled variable in relation to the total usage time of the device, and the control table stipulating the controlled variable in relation to the continuous usage time of the device.

The selection of the plurality of control tables stored in the table storing means can be made based on operation input from operation means.

DETAILED DESCRIPTION OF THE PREFERRED EMBODIMENTS

Embodiment 1

Figure 1:
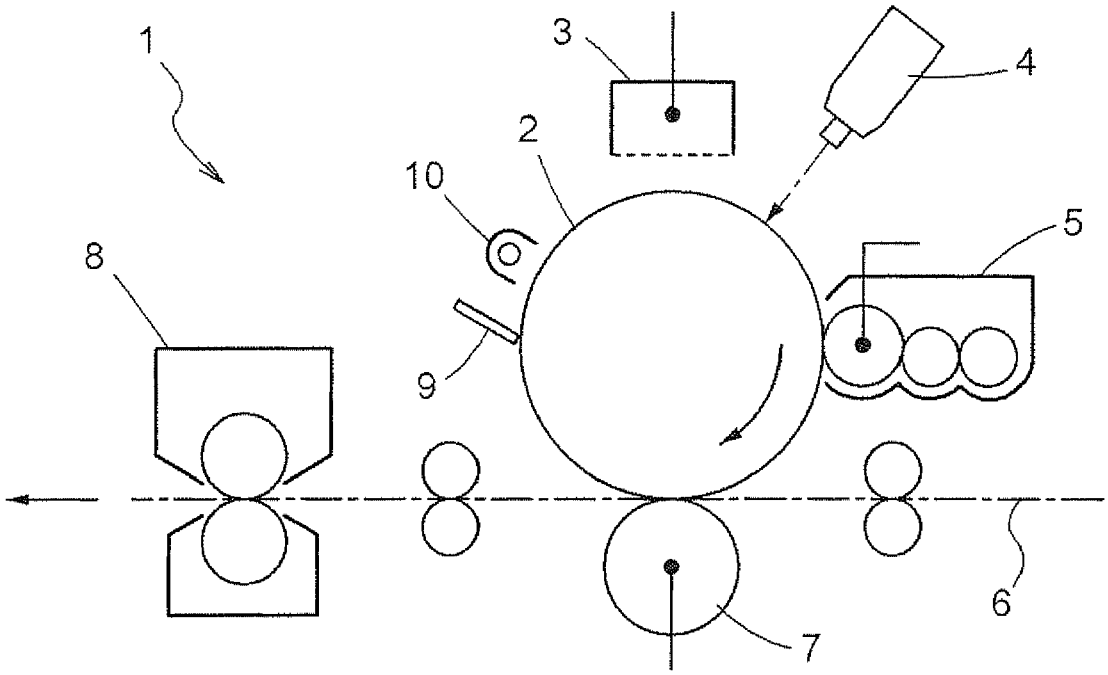
FIG. 1 is a schematic view of an image forming device according to a first embodiment of the present invention.
Figure 2:
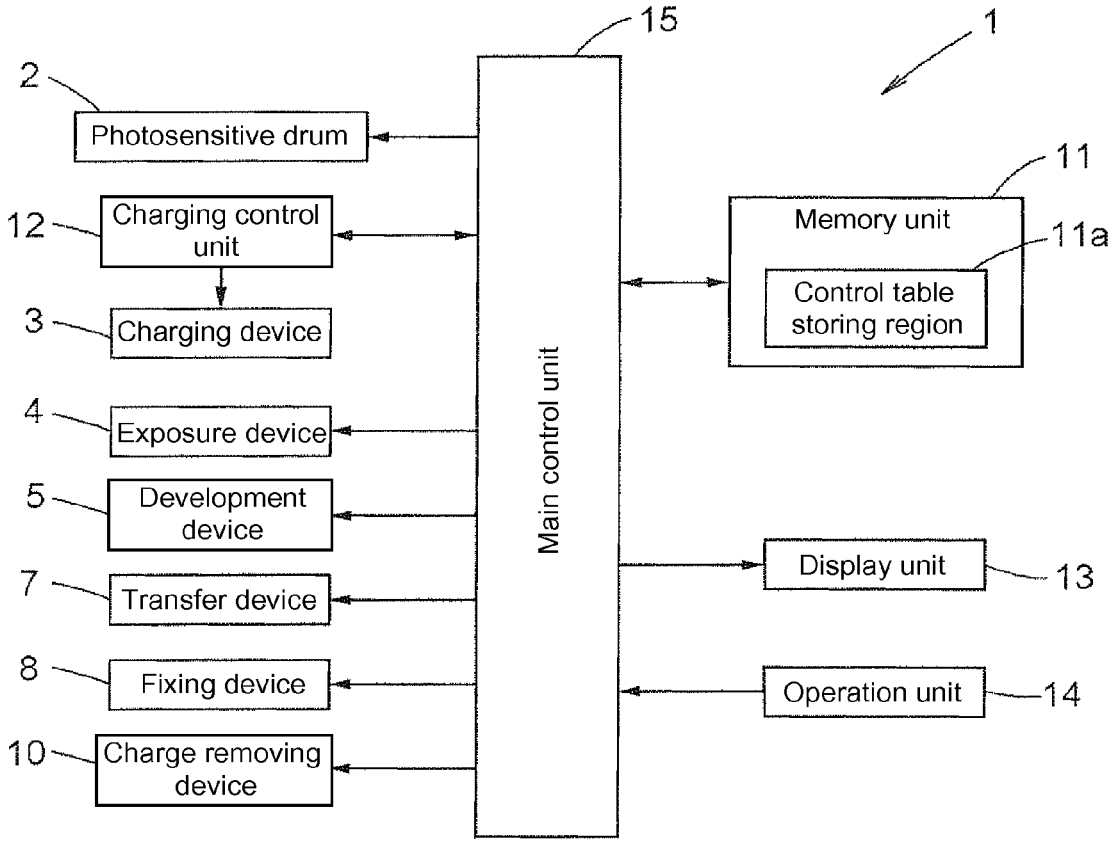
FIG. 2 is a block diagram of the control of the image forming device according to the first embodiment of the present invention.

A first embodiment of the present invention is described with reference to the drawings. FIG. 1 is a schematic view showing the mechanical constitution of an image forming device 1 according to this embodiment; FIG. 2 is a functional block diagram of the image forming device 1 according to this embodiment.

This image forming device 1 comprises: a photosensitive drum 2 with photoconductive material applied to the surface; a charging device 3 for uniformly charging this photosensitive drum 2; an exposure device 4 for partially irradiating the charged photosensitive drum 2 with light based on image data for the image to be formed so as to form an electrostatic latent image; a development device 5 for supplying developer to the image portion of the formed electrostatic latent image so as to develop the image; transfer device 7 for transferring the developer that forms a visible image developed with the development device 5 onto recording paper 6; a fixing device 8 for heating and fixing the developer transferred to the recording paper 6; a cleaning blade 9 for removing developer remaining on the surface of the photosensitive drum 2 after transfer; and a charge removing device 10 for removing charge from the surface of the photosensitive drum 2.

The photosensitive drum 2 comprises a cylindrical member of aluminum or the like with a film of photoconductive material such as amorphous silicon, organic photoconductor (OPC), or the like applied on the outer surface thereof. As discussed below, this photosensitive drum 2 is charged with the charging device 3 so as to take on a fixed surface potential, then the charged surface is partially exposed by the exposure device 4 based on the image data for the image to be formed; thereupon, the potential of the exposed portions drops due to the photoelectric effect of the photoconductive material coated on the surface. An electrostatic latent image is thereby formed on the surface of the photosensitive drum 2. In this embodiment, this photosensitive drum 2 corresponds to the "photosensitive member" of the present invention.

The charging device 3 is on the upstream side of the exposure device 4 in the direction of rotation of the photosensitive drum 2, and is disposed opposite and at a predetermined distance from the surface of the photosensitive drum 2; the charging device 3 comprises a wire for generating corona discharge whereby a high voltage is applied and a grid whereby a predetermined voltage is applied; and this wire and grid uniformly charge the surface of the photosensitive drum 2 by applying a predetermined potential thereto. The voltage applied by the grid, the "grid voltage", is controlled based on a control table selected from among those stored in the control table storing region 11*a*, as discussed below. A charging control unit 12 controls this grid voltage. This charging control unit 12 also performs other operation control of the charging device 3. In this embodiment, the charging device 3 corresponds to the charging means in the present invention and the charging control unit 12 corresponds to the charging control means in the present invention.

The exposure device 4 is disposed on the downstream side of the charging device 3 in the direction of rotation of the photosensitive drum 2; the exposure device 4 partially irradiates with light, based on the image data for the image to be formed, the surface of the photosensitive drum 2 which is uniformly charged with the charging device 3 as discussed above, so as to form the electrostatic latent image. The development device 5 is on the downstream side of the exposure device 4 in the direction of rotation of the photosensitive drum 2; the development device 5 comprises a developing roller opposite the photosensitive drum 2 and uniformly supplies toner, which is the developer, to the image portion of the electrostatic latent image formed on the surface of the photosensitive drum 2 with the application of a fixed developing bias voltage to this developing roller, so as to produce a visible image. The transfer device 7 is disposed on the downstream side of the development device 5 in the direction of rotation of the photosensitive drum 2, and opposite the photosensitive drum 2, with therebetween the transport path of the sheet, to which the developer transfer image that forms the visible image is transferred, so as to transfer to the recording paper 6 the developer that has adhered to the image portion of the electrostatic latent image on the photosensitive drum 2. The transfer device 7 comprises a transfer roller. The fixing device 8 is disposed on the downstream side of the photosensitive drum 2 and the transfer device 7 in the transport direction of the recording paper 6, and fixes the developer transferred to the recording paper 6 by the transfer device 7 by the application of heat and pressure.

As shown in FIG. 2, the image forming device 1 comprises a display unit 13 comprising a liquid crystal display screen, LEDs, or the like for displaying the operating state, settings, and the like; and an operation unit, 14 comprising various operation keys such as a start key, a numeric key pad, and the like, for the user to input operation commands such as an image forming command and the like. The display unit 13 and operation unit 14 may also be constituted by a touch panel combining both units.

A main control unit 15 controls the operations of each part of the image forming device 1. Specifically, the main control unit 15 is connected with each part constituting the image forming device 1; the main control unit 15 performs various calculation processing necessary for operational control of each part and outputs signals for operational commands to each part. The memory unit 11 is a part for temporarily storing various programs, operation tables and the like, which are necessary for the operation of the main control unit 15, and various types of data and the like, which are captured in the course of operating the image forming device 1.

Figure 3:
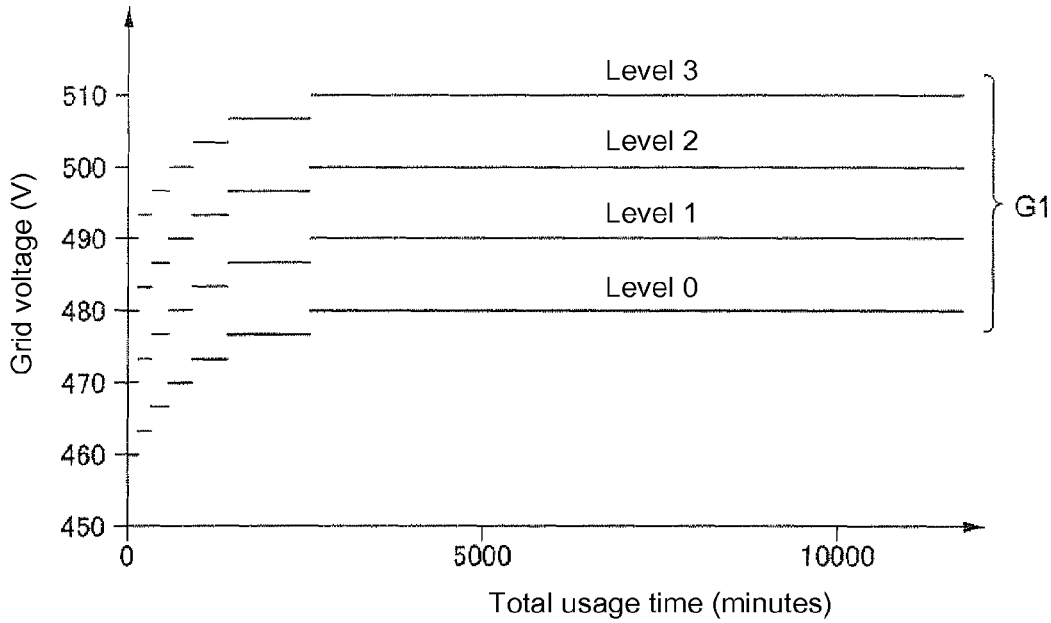
FIG. 3 shows an example of a control table with a plurality of levels incrementally stipulating the controlled variable in relation to the total usage time of the device, in the image forming device according to the first embodiment of the present invention.
Figure 4:
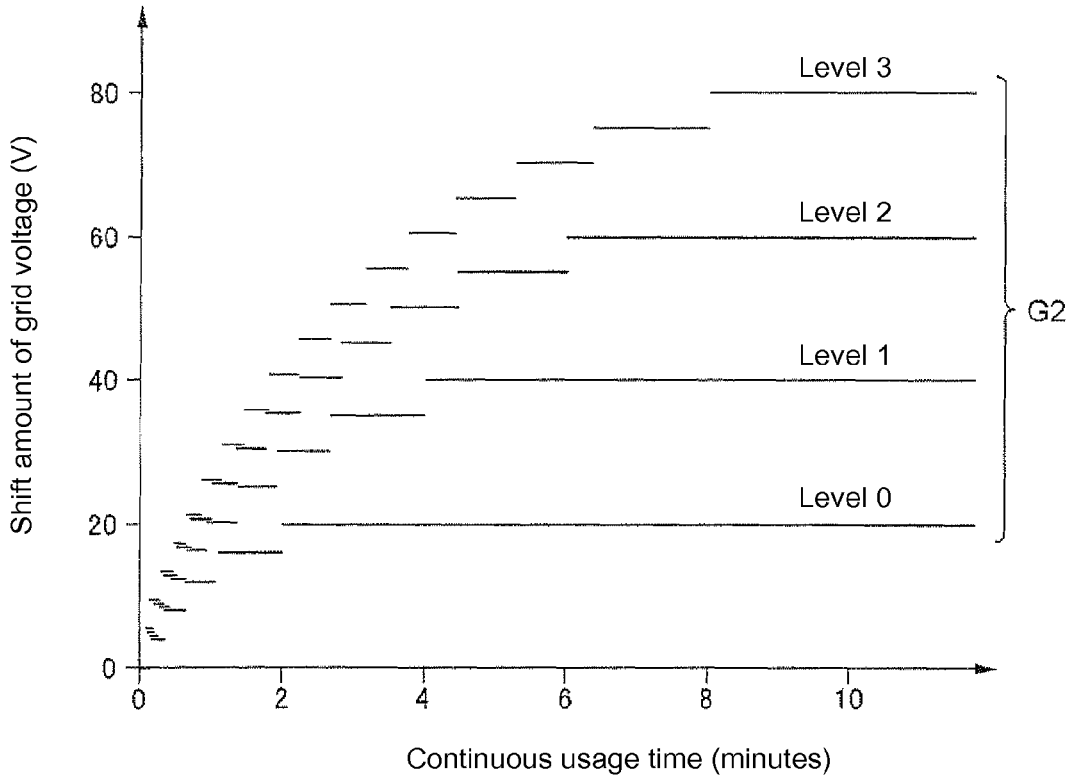
FIG. 4 shows an example of a control table with a plurality of levels stipulating incrementally the controlled variable in relation to the continuous usage time of the device, in the image forming device according to the first embodiment of the present invention.

A control table storing region 11*a* for storing a plurality of control tables stipulating the controlled variable, for controlling the charging output of the charging device 3 with the charging control unit 12 in relation to the passage of time, is provided in this memory unit 11. The memory unit 11 in which this control table storing region 11*a* is provided corresponds to the table storing means in the present invention. In this embodiment, the control tables stored in the control table storing region 11*a* are described for a case where these control tables include control tables stipulating the controlled variable in relation to the total usage time of the image forming device 1, and control tables stipulating the controlled variable in relation to the continuous usage time of the image forming device 1. FIG. 3 and FIG. 4 show concrete examples of control tables stored in the control table storing region 11*a*; the control tables used in this embodiment are described in detail below based on these drawings.

FIG. 3 shows an example of control tables for a plurality of levels stipulating the controlled variable incrementally in relation to the total usage time of the image forming device 1. Hereinafter, the control tables stipulating a plurality of levels are referred to as the first control table group G1. This first control table group G1 has as the horizontal axis the total usage time since the initial operation of the image forming device 1, and as the vertical axis the grid voltage for controlling the charging output of the charging device 3; the first control table group G1 stipulates as the controlled variable the grid voltage, which varies according to the total usage time of the image forming device 1. In the example shown in FIG. 3, the first control table group G1 includes four control tables stipulated incrementally in four levels from level 0 to level 3. In the level 0 control table, the grid voltage is stipulated to be 460 V when the image forming device 1 is initially operated, and to increase incrementally until the total operation time becomes 2500 minutes, and thereafter to remain constant at 480 V. Each of the control tables from level 1 to level 3 is defined so as to shift in parallel 10 V increases with respect to the control tables at the adjacent levels.

FIG. 4 shows an example of a control table for a plurality of levels stipulating the controlled variable incrementally in relation to the continuous usage time of the image forming device 1. Hereinafter, the control tables for the plurality of levels defined in this manner are referred to as the second control table group G2. This second control table group G2 has, as the horizontal axis, the continuous usage time of the image forming device 1 and, as the vertical axis, the amount by which the grid voltage of the charging device 3 is shifted when the image forming device 1 is initially operated, and stipulates as the controlled variable the amount by which the grid voltage, which changes with the continuous usage time of the image forming device 1, is shifted. In the example shown in FIG. 4, the second control table group G2 includes four control tables stipulated incrementally in four levels from level 0 to level 3. In the level 0 control table, the shift amount for the grid voltage is stipulated to be 0 V when the image forming device 1 is initially operated, and to increase incrementally until the continuous usage time becomes approximately 2 minutes, and thereafter to remain constant at 20 V. In each of the control tables from level 1 to level 3, it is stipulated that the shift amount for the grid voltage is the same 0 V when the image forming device 1 is initially operated; as the shift amount increases incrementally thereafter until becoming constant, the continuous usage time increases by two minutes for each level; and the constant shift amount for the grid voltage is 20 V increases. The continuous usage time of the image forming device 1 is the time during which the image forming operation is performed continuously. Consequently, when the image forming operation of the image forming device 1 stops once and then starts again, the shift amount for the grid voltage returns to 0 V when the image forming device 1 begins to be used.

The control tables in this second control table group G2 have the effect of suppressing the fogging phenomenon which is caused by filming, when the filler in the recording paper 6 covers the surface of the photosensitive drum 2. The charging properties of the surface of the photosensitive drum 2 have the tendency of changing greatly due to filming as the image forming operation continues, and reverting when the image forming operation is interrupted for a period of time. Changing the shift amount for the grid voltage over the continuous usage time of the image forming device 1 can effectively suppress the fogging phenomenon due to filming.

The first control table group G1 and the second control table group G2 are each constituted to include four levels of control tables from level 0 to level 4. The difference between the grid voltage, or the shift amount for the grid voltage, between adjacent levels in the control tables for a plurality of incrementally stipulated levels is preferably set based on the amount of change in grid voltage necessary to reduce the visible adhesion of developer to the non-image part of the image that is transferred to the recording paper 6 to a non-visible level. The non-image part of the image transferred to the recording paper 6 is the part of the image where developer does not originally adhere, meaning the blank part; the phenomenon of developer adhering to this part is the so-called fogging phenomenon. In the present embodiment, as discussed below, because a control table from the first control table group G1 and a control table from the second control table group G2 are used in combination, it is preferable to set the difference between the grid voltage, or the shift amount for the grid voltage, between adjacent levels so that, when the fogging phenomenon occurs to a visible extent, the amount of change to the grid voltage resulting from incrementing upwards both of the control tables from the first control table group G1 and the second control table group G2 is greater than the amount of change to the grid voltage necessary to reduce the fogging phenomenon to a non-visible level. The amount of change to the grid voltage necessary to reduce the visible fogging phenomenon to a non-visible level may be found through experimentation or simulation.

For the four levels of control tables incrementally stipulated from level 0 to level 4 of both the first control table group G1 and the second control table group G2, the control table at each level is preferably stipulated to match the properties of the each of the recording papers 6 which can be used in the image forming device 1. The properties of the recording paper 6 used in the image forming device 1, particularly the properties of the filler included in the recording paper 6, have a great influence on the occurrence of the fogging phenomenon. For example, in the case where the recording paper 6 includes a large proportion of fillers such as heavy calcium carbonate and talc, the fogging phenomenon will tend to occur in relatively quickly, compared to the recording paper 6 which uses other fillers such as light calcium carbonate or the like, because filler and other impurities easily damage the surface of the photosensitive drum 2, and easily adhere to the surface of the photosensitive drum 2. When the properties of the recording papers 6 likely to be used in the image forming device 1 are known in advance, control tables for each level are preferably stipulated to match the properties of those recording papers 6. Accordingly, when starting to use the image forming device 1, or during use thereof, the user selects the level of control table that matches the properties of the recording paper 6 that will be principally used, so that the control table level does not subsequently have to be changed, making it possible to suitably set the grid voltage, or shift amount for the grid voltage, so as to suppress the fogging phenomenon. Control tables matching the properties of the recording paper 6 may be found by experiment or simulation for each recording paper.

Next, control of the charging output in the image forming device 1 according to this embodiment is described. The main control unit 15 reads a predetermined control table from the control table storing region 11*a* in the memory unit 11 and sends it to the charging control unit 12; the charging control unit 12 adjusts the grid voltage of the charging device 3 according to that control table, whereby the charging output is controlled. As above, in this embodiment, the first control table group G1 and second control table group G2 are stored in the control table storing region 11*a* of the memory unit 11; the charging control unit 12 controls the charging output using control tables from both these two control table groups. The control tables in the first control table group G1 stipulate the controlled variable in relation to the total usage time of the image forming device 1; the control tables in the second control table group G2 stipulate the controlled variable in relation to the continuous usage time of the image forming device 1; therefore, the grid voltage of the charging device 3 is controlled based on the control table selected from the first control table group G1, in combination with the control table selected from the second control table group G2. Specifically, the grid voltage determined on the basis of the total usage time from the initial operation of the image forming device 1, according to the control table selected from the first control table group G1, becomes the grid voltage when the image forming device 1 is initially operated. The grid voltage at the initial operation is changed over the passage of time according to the shift amount for the grid voltage, determined on the basis of the continuous usage time since initial operation, with the control table selected from the second control table group G2.

The control table selected from the first control table group G1 and the control table selected from the second control table group G2 are selected such that both have the same level; the user of the image forming device 1 preferably selects any control table from level 0 to level 4 as the charging control level. Accordingly, the user of the image forming device 1 can adjust the charging output simply by selecting the level, even if unaware of the details of the control tables included in both the first control table group G1 and the second control table group G2. At this time, the charging control level can be selected by the user performing an input operation with the operation unit 14 while referencing the display on the display unit 13. Specifically, the user operates the operation unit 14 so as to enter the charging adjustment mode, as a result of which the current charging control level is displayed on the liquid crystal display screen or the like of the display unit 13; preferably, the user is then able to input a change in the level by operating the keys of the operation unit 14.

The method for adjusting the charging control level at this time can be performed as follows. Specifically, upon shipment of the image forming device 1, the charging control setting is set so that level 0 is selected; the user changes the charging control setting to level 1 when the fogging phenomenon arises with ongoing use of the image forming device 1. When the fogging phenomenon arises again ongoing use, the user can select the appropriate level in the control table by going to the next level, so as to change the charging control setting to level 2. When the correspondence between the properties of the recording paper 6 used in the image forming device 1 and the charging control setting level is known in advance, the user can set the appropriate level easily, and with a one time operation, by selecting the setting level for the recording paper 6 used in the image forming device 1.

Second Embodiment

Figure 5:
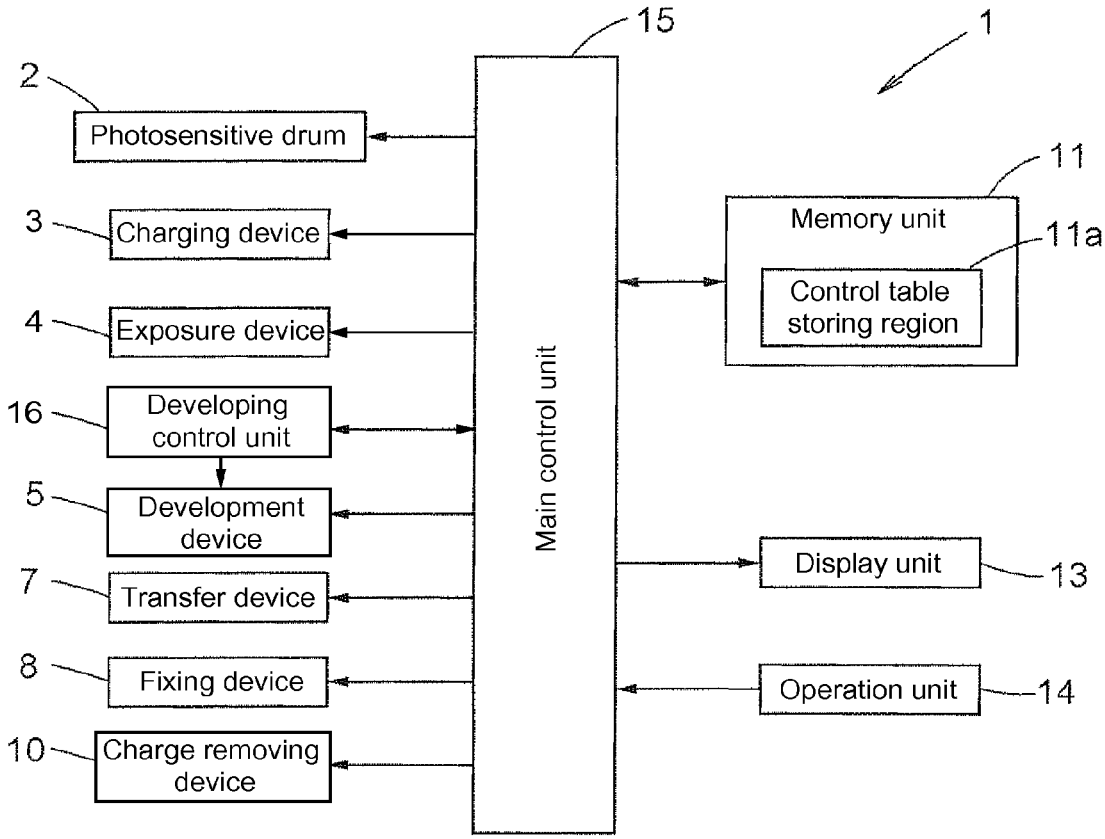
FIG. 5 is a block diagram of the control of an image forming device according to a second embodiment of the present invention.

The second embodiment of the present invention is described below. An image forming device 1 according to this embodiment differs from the first embodiment in the aspect of controlling the developing bias of the development device 5 instead of controlling the charging output of the charging device 3. FIG. 5 is a block diagram of the control of the image forming device 1 according to this embodiment. The constitution of the image forming device 1 is the same as that shown in FIG. 1. As shown in FIG. 5, the image forming device 1 according to this embodiment has a constitution wherein the operation of the development device 5 is controlled by the developing control unit 16. The developing control unit 16 also controls the developing bias voltage of the development device 5. Consequently, the developing control unit 16 corresponds to the "developing bias control means" in this invention.

A plurality of control tables stipulating the controlled variable, for controlling the developing bias of the development device 5 with the developing control unit 16 in relation to the passage of time, are stored in the control table storing region 11*a* of the memory unit 11. In this embodiment, the control tables stored in the control table storing region 11*a* are described for a case where these control tables include only control tables stipulating the controlled variable in relation to the total usage time of the image forming device 1, unlike the first embodiment.

Figure 6:
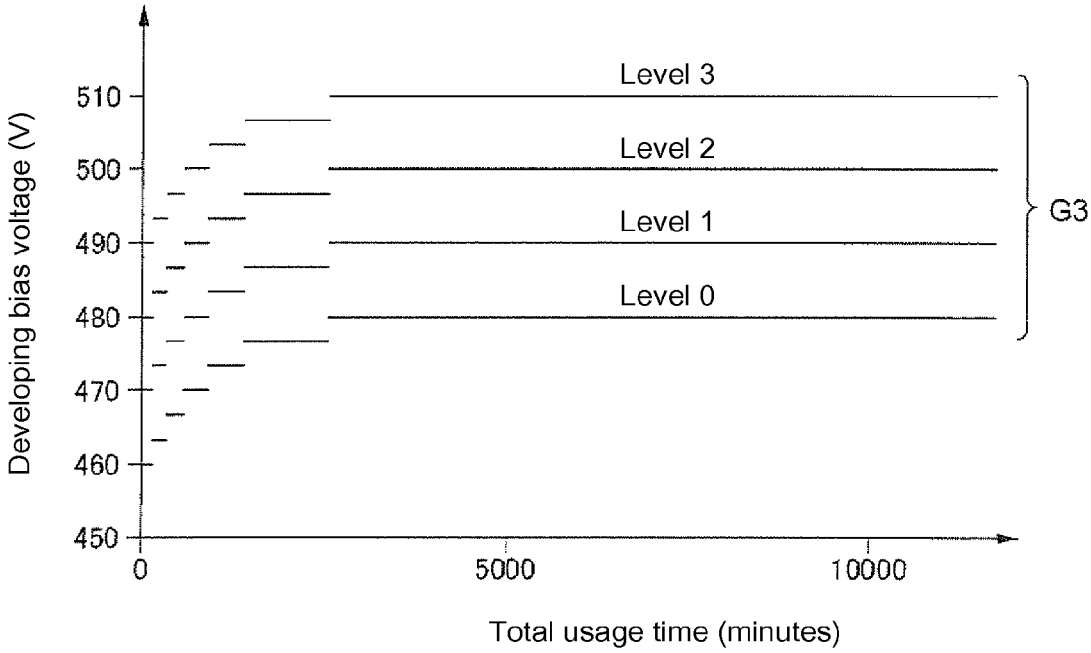
FIG. 6 shows an example of a control table with a plurality of levels stipulating incrementally the controlled variable in relation to the total usage time of the device, in the image forming device according to the second embodiment of the present invention.

FIG. 6 is a drawing showing a concrete example of the control tables stored in the control table storing region 11*a*, and shows an example of the control tables for a plurality of levels incrementally stipulating the controlled variable in relation to the total usage time of the image forming device 1. Hereinafter, the control tables of a plurality of levels stipulated in this way are referred to as the control table group G3. This control table group G3 has, as the horizontal axis, the total usage time since the image forming device 1 was initially operated, and as the vertical axis, the developing bias voltage for controlling the developing bias of the development device 5; the control table group G3 stipulates as the controlled variable the developing bias voltage, which varies according to the total usage time of the image forming device 1. In the example shown in FIG. 6, the control table group G3 includes four control tables stipulated incrementally in four levels from level 0 to level 3. In the level 0 control table, the developing bias voltage is stipulated to be 460 V when the image forming device 1 is initially operated, and to increase incrementally until the total operation time becomes 2500 minutes, and thereafter to remain constant at 480 V. Each of the control tables from level 1 to level 3 is stipulated to shift in parallel 10 V increases with respect to the control tables at the adjacent levels.

As in the first embodiment, the difference between the developing bias voltage at adjacent levels of the control tables for a plurality of incrementally stipulated levels in this control table group G3 is preferably set based on the amount of change to the developing bias voltage necessary to reduce the visible adhesion of developer to non-image parts of the image transferred to the recording paper 6 to a non-visible level. In this embodiment, as discussed below, because only one control table group G3 is used, the difference between the developing bias voltage of adjacent levels is preferably set so that the amount of change to the developing bias voltage resulting from increasing the level of the control table by one is greater than the amount of change to the developing bias voltage necessary to reduce the fogging phenomenon to a non-visible level, when the fogging phenomenon occurs at a visible level. The amount of change to the developing bias voltage necessary to reduce the visible fogging phenomenon to a non-visible level may be found through experimentation or simulation. The control tables of four incrementally stipulated levels from level 0 to level 4 in the control table group G3 are preferably stipulated so that the control table of each level matches the properties of each recording paper 6 which is likely to be used in the image forming device 1. The control tables matching the properties of the recording paper 6 may be found by experiment or simulation for each recording paper.

The control of the developing bias in the image forming device 1 according to this embodiment is described next. The main control unit 15 reads a predetermined control table from the control table storing region 11*a* in the memory unit 11 and sends it to the developing control unit 16; the developing control unit 16 adjusts the developing bias voltage of the development device 5 according to that control table, whereby the developing bias is controlled. Control is performed so that the developing bias voltage determined on the basis of the total usage time from the initial operation of the image forming device 1, according to the control table selected from the control table group G3 stored in the control table storing region 11*a*, is the developing bias voltage of the image forming device 1 at that time. The level of the control table selected from the control table group G3 is preferably selected as the developing bias control level by the user of the image forming device 1. At this time, the developing bias control level can be selected by the user performing an input operation with the operation unit 14 while referencing the display of the display unit 13. Specifically, the user operates the operation unit 14 so as to enter the developing bias adjustment mode, as a result of which the current developing bias control level is displayed on the liquid crystal display screen or the like in the display unit 13; preferably, the user is then able to input a change in the level by operating the keys of the operation unit 14. The method for adjusting the developing bias control level at this time can be performed in the same manner as in the first embodiment.

Other Embodiments

In the first and second embodiments, the description concerned the case of four levels of control tables included in one control table group; however, the present invention is not limited to this and may have an appropriate number of levels corresponding to performance of the image forming device 1, the type of recording paper 6 likely to be used, and the like. The number of control table groups, meaning the number of types of methods for stipulating control tables, is not limited to one or two, as in the above embodiments, and three or more control table groups can be used in order to make possible more appropriate control. The method for stipulating the control tables at this time is not limited to that shown in the embodiments and it is possible to use other control tables stipulated in relation to the passage of time.

What is claimed is:

1. An image forming device comprising:

charging means for uniformly charging the surface of a photosensitive member;

charging control means for controlling the charging output of the charging means; and table storing means for storing a plurality of control tables stipulating a controlled variable for controlling the charging output in relation to the passage of time, each of the plurality of the control tables having a different controlled variable in accordance with a usage time of the image forming device, the usage time being a total amount of usage time or a continuous amount of usage time of the image forming device, the charging control means controlling the charging output based on one or more control tables selected from among the plurality of control tables stored in the table storing means.

2. The image forming device recited in claim 1, wherein the plurality of control tables stored in the table storing means include control tables for a plurality of levels stipulating the controlled variable incrementally in relation to a predetermined passage of time.

3. The image forming device recited in claim 2 further comprising an image forming unit for partially exposing a photosensitive member after uniform charging, forming an electrostatic latent image, supplying developer to and developing the image part of this electrostatic latent image, and transferring the image to recording paper, wherein the difference between the controlled variables at adjacent levels of the control tables for a plurality of incrementally stipulated levels is set based on the amount of change to the controlled variable required to reduce visible adhesion of developer to non-image parts of the image transferred to recording paper to a non-visible level.

4. The image forming device recited in claim 2 further comprising image forming unit for partially exposing a photosensitive member after uniform charging, forming an electrostatic latent image, supplying developer to and developing the image part of this electrostatic latent image, and transferring the image to recording paper, wherein the control tables for a plurality of incrementally stipulated levels are stipulated so that a control table at each level matches the properties of each recording paper that is usable in the device.

5. The image forming device recited in claim 1 wherein the plurality of control tables stored in the table storing means include at least one of a control table stipulating the controlled variable in relation to the total usage time of the device, and a control table stipulating the controlled variable in relation to the continuous usage time of the device.

6. The image forming device recited in claim 1, wherein the selection of the plurality of control tables stored in the table storing means is selectable based on operation input from operation means.

7. The image forming device recited in claim 1 wherein the plurality of control tables stored in the table storing means include at least a control table stipulating the controlled variable in relation to the total usage time of the device, or a control table stipulating the controlled variable in relation to the continuous usage time of the device.

8. A image forming device comprising:

charging means for uniformly charging the surface of a photosensitive member;

charging control means for controlling the charging output of the charging means;

table storing means for storing a plurality of control tables stipulating a controlled variable for controlling the charging output in relation to the passage of time, the plurality of control tables stored in the table storing means include control tables for a plurality of levels stipulating the controlled variable incrementally in relation to a predetermined passage of time; and an image forming unit for partially exposing a photosensitive member after uniform charging, forming an electrostatic latent image, supplying developer to and developing the image part of this electrostatic latent image, and transferring the image to recording paper, the charging control means controlling the charging output based on one or more control tables selected from among the plurality of control tables stored in the table storing means, and the control tables for a plurality of incrementally stipulated levels are stipulated so that a control table at each level matches the properties of each recording paper that is usable in the device.

9. The image forming device recited in claim 8 wherein the plurality of control tables stored in the table storing means include at least a control table stipulating the controlled variable in relation to the total usage time of the device, and a control table stipulating the controlled variable in relation to the continuous usage time of the device.

* * * * *